United States Patent [19]

Dee et al.

[11] Patent Number: 4,505,198

[45] Date of Patent: Mar. 19, 1985

[54] APPARATUS AND METHOD FOR APPLYING PRINTED MATERIAL TO A CYLINDRICAL OBJECT

[76] Inventors: Richard D. Dee, 921 W. Macada Rd., Bethlehem, Pa. 18017; Louis A. DiGiacomo, 600 Orchid Cir., Emmaus, Pa. 18149; Geza Tomosy, 626 Hillview Rd., Allentown, Pa. 18103

[21] Appl. No.: 536,286

[22] Filed: Sep. 27, 1983

Related U.S. Application Data

[63] Continuation-in-part of Ser. No. 230,631, Feb. 2, 1981, abandoned.

[51] Int. Cl.[3] ..... B41F 17/08

[52] U.S. Cl. ..... 101/40; 101/126; 101/129; 118/213

[58] Field of Search ..... 101/230, 631, 40, 38 R, 101/38 A, 39, 7, 8, 125, 126, 129, 426; 118/213, 406

[56] References Cited

U.S. PATENT DOCUMENTS

| | | | |
|---|---|---|---|
| 2,056,273 | 10/1936 | Holdsworth | 118/213 X |
| 2,703,047 | 3/1955 | Scherer et al. | 101/8 |
| 2,796,164 | 6/1957 | Hakogi | 198/482 |
| 3,260,194 | 7/1966 | Karlyn | 101/38 R |
| 3,277,816 | 10/1966 | Olsen | 101/38 R |
| 3,503,329 | 3/1970 | Rossi | 101/40 |
| 3,518,939 | 7/1970 | Donner et al. | 101/40 |
| 3,530,792 | 9/1970 | Valiela | 101/41 |
| 3,538,845 | 11/1970 | Peck | 101/38 A |
| 3,564,998 | 2/1971 | Johnson et al. | 101/40 |
| 3,608,480 | 9/1971 | Sciame | 101/7 |
| 4,098,183 | 7/1978 | Johnson | 101/40 |

*Primary Examiner*—Edgar S. Burr
*Assistant Examiner*—Moshe I. Cohen
*Attorney, Agent, or Firm*—Mark L. Rodgers; James D. Dee

[57] ABSTRACT

An apparatus for applying printed material to a cylindrical object is provided which eliminates the need for individually chucking each object, thereby significantly decreasing production time. The need for a squeegee to transfer the paint or dye onto the cylindrical object is also eliminated, resulting in longer screen life and further decreasing production time. A process for using this improved apparatus is also provided for.

22 Claims, 4 Drawing Figures

APPARATUS AND METHOD FOR APPLYING PRINTED MATERIAL TO A CYLINDRICAL OBJECT

CROSS REFERENCE TO PARENT APPLICATION

This is a continuation-in-part of Ser. No. 230,631 filed Feb. 2, 1981, now abandoned, the subject matter of which is hereby incorporated by reference.

TECHNICAL FIELD OF THE INVENTION

The present invention relates generally to the field of screen printing, and in particular, to the screen printing of informative or decorative material on an object having a cylindrical surface.

BACKGROUND OF THE INVENTION

One method commonly used to apply informative or decorative material to a surface is screen printing. This method generally involves the use of a fine mesh screen stretched over a frame. The surface of the screen is provided with a pattern which corresponds to the informative or decorative material to be transferred to the surface of the object. A variety of techniques are known for producing such a screen, one example being to coat the screen material with a non-permeable photosensitive emulsion upon which the desired pattern can be exposed and processed. The frame serves as a reservoir for the ink or dye which is used in the printing process.

In order to use such a screen to apply a pattern to an object having a flat surface, the object to which the pattern is to be applied is generally positioned underneath and in close proximity to the prepared screen. A squeegee is then passed across the surface of the screen, and in particular, over that portion of the screen which is provided with the pattern to be applied to the object. As the squeegee advances across the screen, the ink or dye contained within the framed screen is caused to pass through those pores of the screen which define the pattern, which transfers the pattern from the screen to the surface of the object which is contacted by the screen, producing the desired printed image.

In order to use such a screen to apply a pattern to an object having a cylindrical surface, such as a bottle, a system of stationary, rotating chucks must often be used. In use, the cylindrical object is engaged by a chuck at each of its ends. For example, a bottle would generally be engaged at its base and its mouth. The chucked object is then positioned underneath and in close proximity to the prepared screen. A squeegee is simultaneously positioned on the opposing side of the screen, adjacent the curved outer surface of the bottle to which the pattern is to be applied. In this manner, the squeegee maintains contact between the bottle and the screen. The screen is then drawn across the curved outer surface of the object, while the object is permitted to rotate within the chuck. In so doing, the ink or dye contained within the framed screen is caused to pass through those pores of screen which define the pattern, which transfers the pattern from the screen to the surface of the cylindrical object, producing the desired printed image.

One example of such a process is disclosed in U.S. Pat. No. 3,518,939. In this disclosure, cylindrical bottles are mounted on a chuck and rotated over the top of a screen. The paint or dye is forced through the screen by a squeegee conveyor means which moves in an endless path of travel beneath the screen.

Such techniques, although effective, are seriously limited in the rate of production which they can attain. This is particularly so with regard to systems used to apply a pattern to cylindrical objects. The primary cause for this limitation in production rate relates to the need to separately insert and remove the objects from the chucks, the ability to print only one object at a time, and by the alternating motions required to set up the screen and squeegee for the next printing procedure.

In addition to the increase in production time, the use of a squeegee which continually passes over the screen, causes considerable wear to the screen, necessitating frequent replacement.

It is therefore extremely desirable to develop an apparatus and method for applying a printed pattern to a cylindrical object which obviates the foregoing limitations, and which accordingly permits a significant increase in the production rate.

BRIEF SUMMARY OF THE INVENTION

The present invention relates to an improved apparatus and process for applying printed material to arcuate surface portions of cylindrical objects. The apparatus comprises a screen which contains a pattern of the printed material which is to be transferred to the cylindrical object. The screen is supported on a non-absorbent support device such that paint or dye can form a thin layer between the screen and the support. A plurality of endless belts is located opposite the screen from the support device and positioned parallel to, and away from, the screen such that the cylindrical object is contacted by the plurality of endless belts and transported across the screen. The force of the cylindrical object traveling over the screen forces the layer of paint between the screen and the support device to permeate the screen and become affixed to the cylindrical object.

This apparatus eliminates the need for individually chucking each cylindrical object to be printed, thereby allowing several objects to be printed simultaneously. Also, the elimination of a squeegee, which is required by the prior art, serves to further reduce production time and increase screen life.

BRIEF DESCRIPTION OF THE DRAWINGS

In the figures provided, like reference numerals denote similar structures.

DETAILED DESCRIPTION OF THE INVENTION

Figure 1:
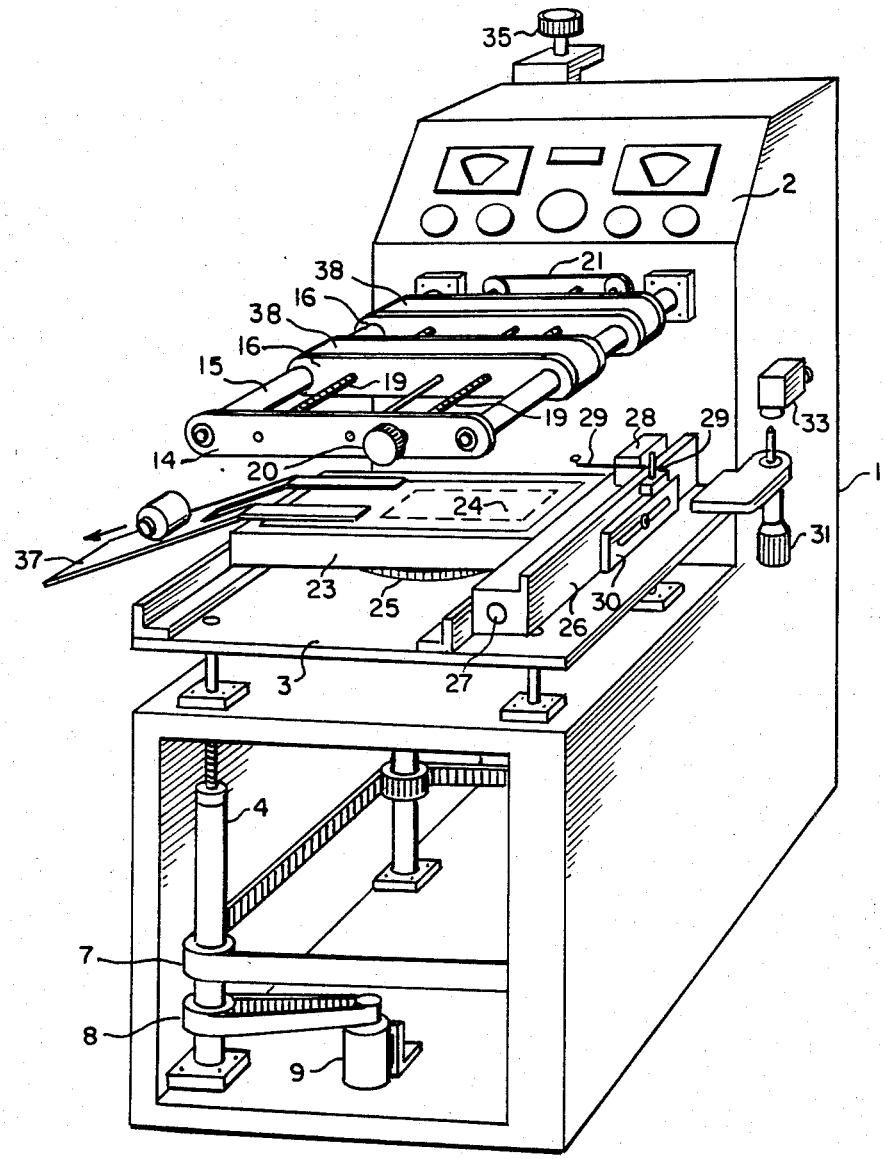
FIG. 1 is a frontal view of the screen printing apparatus.

The present invention provides for an improved apparatus and process for applying printed material to a cylindrical object. Examples of such printed material include patterns, designs, numbers and lettering. Any type of cylindrical object can be used, however, plastic or glass bottles are most common.

In general, this invention comprises a screen containing the pattern to be transferred to the object supported by a non-absorbent support device having a leading end and a trailing end. The screen and support device remain essentially stationary throughout the operation. A thin layer of paint is applied between the screen and the support device. Preferably the paint is positioned between the screen and the support device at a point close to the leading end of said support device. The term paint is used to include ink, dye, acrylic, polyester, epoxy, thermosetting powder, alkydurea or any other type of organic coating used in the art to apply printed materials to various objects.

A chuckless advancing means is employed for receiving and continuously rolling the cylindrical object across the screen opposite the non-absorbent support device. The force of the bottle across the screen causes the paint to spread across the screen and also through the screen and onto the arcuate surface portion of the cylindrical object.

This invention is superior to the prior art in that the need for separately chucking each bottle, either manually or automatically, is eliminated. The chuckless advancing means allows for the pattern to be simultaneously and continuously transferred to a plurality of cylindrical objects. Also, since the cylindrical objects themselves force the paint through the screen, a squeegee is not needed. This eliminates the alternating motion of the prior art screen and squeegee apparatus for printing each bottle.

These improvements result in an increased rate of production over any method previously disclosed. While U.S. Pat. No. 3,518,939 employs a conveyorized system, each object must be individually chucked, and a squeegee apparatus must also be used to apply the paint, resulting in a much less efficient process the present invention. In addition, since this reference does not use a non-absorptive support, only heavy paints which can adhere to the screen without excessive dripping can be used.

A clear understanding of the present invention can be had by reference to the accompanying drawings. Although specific forms of the invention have been selected for illustration in the drawings, the drawings themselves and the description thereof are not intended to limit the scope of the present invention.

FIG. 1 illustrates a preferred embodiment of a screen printing apparatus. Such an apparatus is generally supported on some type of frame 1. A control panel 2 for regulating the various functions of the apparatus can be included on the frame 1 or located separate from the rest of the apparatus. It is also preferred that the frame 1 contain a support pad plate 3 for supporting a non-absorbent support device 24. The height of the support pad plate 3 can be adjusted relative to an advancing means 38 by means of a elevator mechanism 4 which is driven by a power take-off belt 8 in combination with a motor 9. If more than one elevator mechanism 4 is used, a common belt drive 7 can be included to insure that the printing pad support plate 3 remains level.

The non-absorbent support device 24 is attached on top of the support pad plate 3, or optionally, is positioned on a support block 23, which in turn is attached to the support pad plate 3. The non-absorbent support device 24 is generally a pad which can be of any type material which is impervious to print and similar types of organic compounds. It is preferred that this pad also be slightly resilient; Neoprene Foam is a good example of such a material. A screen (not shown) which contains the design to be transferred to the cylindrical object is secured on top of the non-absorbent support device 24. A pad pressure adjustment disc 25 positioned below the support device 24, may optionally be provided, to allow the pressure exerted by the support device 24 on the screen to be adjusted. After the non-absorbent support device 24 and the screen are adjusted to the desired height by means of the elevator mechanism 4, they remain essentially stationary throughout the printing operation.

Paint is delivered to a point between the screen and the leading end of the non-absorbent support device 24, i.e. the end which first comes in contact with the cylindrical object. The means for delivering paint to this position is described in detail below.

A chuckless advancing means 38 is positioned parallel to and away from, the screen opposite the non-absorbent support device 24. This chuckless advancing means 38 receives and continuously rolls the cylndrical object across the surface of the screen. As the cylindrical object is advanced across the screen, it forces the paint positioned between the screen and the leading end of the non-absorbent support device 24 across the support device and through the screen and out the arcuate surface portion of the cylindrical object.

The chuckless advancing means 38 is preferably a plurality of endless belts. The endless belts are anchored to the frame 1 by main shafts 15 positioned perpendicular to the advancing means, and connected opposite the frame to support bar 14. The distance between the endless belts can be adjusted to accommodate various bottle lengths by means of a distance adjustment screen handle 20 which turns a pair of adjustment screens 19, which in turn are in contact with support arms 15 located adjacent to each side of the endless belts. It is preferred that the endless belts contact the surface of the cylindrical object only along its endmost portion. A gear belt pulley 21 may be provided to allow for tandem drive of the two adjustment screens 19, such that there remains an equal distance between the endless belts along the entire length of the belts.

The endless belts are caused to rotate about the main shafts 15 by any conventional power means, such as an electric motor. The speed of rotation of the endless belts can also be adjusted by the power means.

The cylindrical objects enter the apparatus along a feed chute 26 located adjacent to the leading end of the support device 24. The feed chute can be of any length and can be designed to accommodate and automatically introduce a plurality of cylindrical objects to the apparatus. The cylindrical objects travel the length of the feed chute 26 until they are positioned between the support device 24 and the advancing means 38, i.e. endless belts. Upon reaching this position, the cylindrical object comes in contact with a bottle sensor limit switch 29 which causes a pivotal arm to force the endless belts downward at a point such that the endless belts come in contact with the cylindrical object thereby rotating it across the screen to the trailing end of the support device 24 and exit via bottle exit plate 37. When an object is in contact with the sensor limit switch 29, the endless belts are forced down by the pivotal arms thereby preventing the next object from being positioned between the screen and the belts until the first object is no longer in contact with the sensor limit switch. Therefore, by controlling the length of the sensor limit switch 29, the note of introduction of objects into the apparatus can be controlled. The length of the limit sensor switch can be controlled by an adjustment slide 30 which is functionally connected to the limit switch 29.

A vacuum can be created along the feed chute to help assure proper orientation of the bottles as they enter the apparatus. Vacuum inlet 27 combined with any customary type of vacuum pump can be employed for this purpose. Additionally, a bottle locator or registration block 28 can be positioned at the end of the feed chute 26 to orient the bottles prior to advancing across the screen. By the above means the radial orientation of the cylindrical object can be aligned before it is introduced between the screen and the advancing means.

Figure 2:
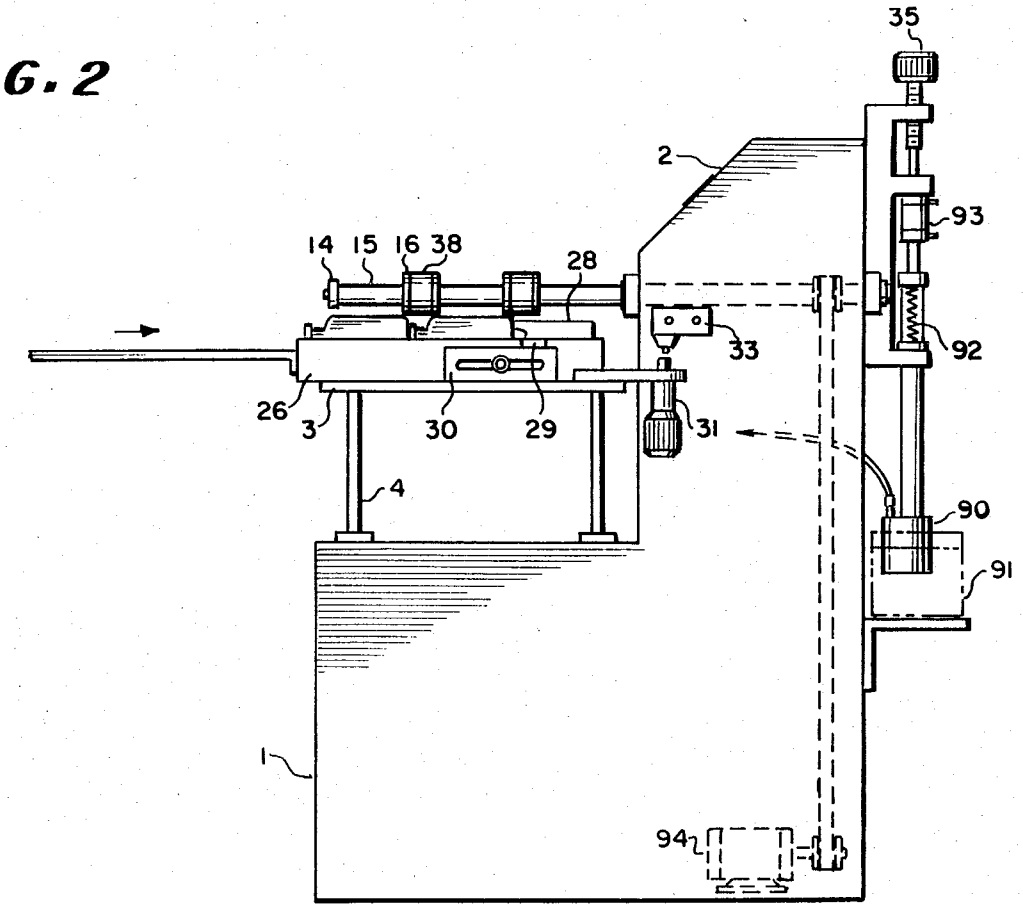
FIG. 2 is a side view of the screen printing apparatus, also illustrating a preferred mechanism for transferring paint to the screen.

FIG. 2 shows a preferred embodiment for providing paint to the screen at a point between said screen and the leading end of the support device. The inlet end of a hollow tube is connected to a paint metering pump 90 located at a point reservoir 91. The outlet end of the hollow tube is positioned such that paint caused to flow through the tube by the pump 91 is forced out at a point between the screen and the leading end of the support device. The amount of paint delivered to the screen is metered by a stroke adjustment knob 35 in combination with an air cylinder 93 and a return compression spring 92 which controls the paint metering pump 90.

This method of delivering paint allows for precise amounts to be supplied to the screen thereby preventing clogging and wasting of paint.

This figure also shows the drive means 94 located inside frame 2 for turning the main shafts 15 which drive the endless belts 38.

A micro adjustment knob 31 which contacts a limit switch 33 can be located on the side of frame 2 to automatically stop the elevator mechanism 4 when the non-absorbent support pad 24 reaches a predetermined height.

Figure 3:
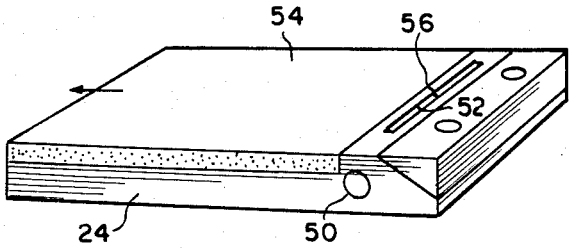
FIG. 3 is a top and side view of the screen and resilient support device.

FIG. 3 illustrates a detailed embodiment of the non-absorbent support device 24. A conduit 50 is located through the leading end of the support device 24. Paint flows into the conduit 50 from a paint reservoir. The conduit 50 is plugged at one end causing the paint flowing into the conduit 50 to exit via a trough 52 located between the screen 54 and the leading end of the support device 24. The paint flow is metered to allow enough paint to exit through the trough such that the cylindrical object traveling over the trough forces enough paint to travel across the bottom of the screen and be forced through the screen and onto the cylindrical object.

Figure 4:
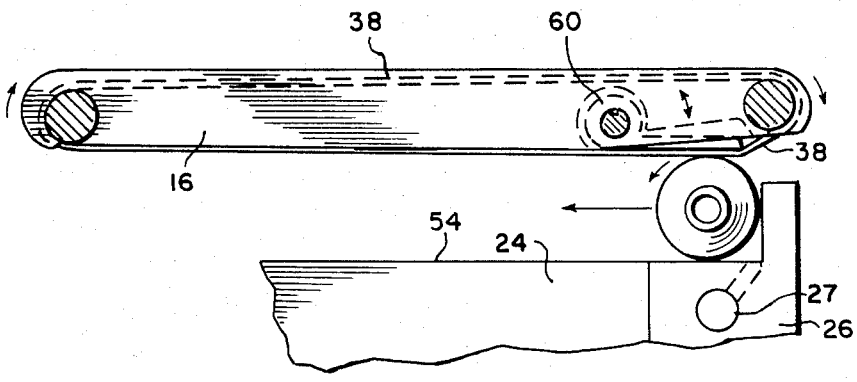
FIG. 4 is a detailed side view of the preferred means for advancing cylindrical objects across the screen.

FIG. 4 is a detailed illustration of the chuckless advancing means 38. As a bottle travels down the feed chute 26, it is held against the chute by the creation of a vacuum space resulting from vacuum inlet 27 in conjunction with a vacuum pump. The bottle is not initially in contact with the advancing means when it advances down the chute 26. When the bottle reaches the end of the chute 26 it contacts the limit sensor switch which sends a signal to engage a pivotal arm 60 positioned so as to force the endless belt downward at a point such that the endless belt contacts the cylindrical object, thereby transporting the object across the screen 54. This allows the cylindrical object to be introduced into the apparatus, advanced through the apparatus, and discharged from the apparatus in a continuous motion.

Having thus described the present invention, what is now deemed appropriate for Letters Patent is set out in the following appended claims.

What is claimed is:

1. An apparatus for transferring a pattern to arcuate surface portions of a cylindrical object which comprises:

(a) a screen containing the pattern to be transferred to the cylindrical object;

(b) a non-absorbent support device, having a leading end and a trailing end, positioned adjacent to one side of the screen, wherein said screen and support device remain stationary;

(c) a means for delivering paint to the leading end of said support device; and (d) a chuckless advancing means for receiving and continuously rolling the cylindrical object across the surface of said screen opposite the support device in a direction from the leading to the trailing end of said support device, such that the arcuate surface portions of the cylindrical object force the paint to advance across the support device and through the screen and onto the arcuate surface of the cylindrical object as said cylindrical object is advanced through and subsequently discharged from the apparatus.

2. The apparatus in accordance with claim 1 wherein said cylindrical object is a bottle.

3. The apparatus in accordance with claim 1 wherein said means for delivering paint to the leading end of the support device comprises a hollow tube through which said paint can flow, said hollow tube having an inlet end connected to a paint metering pump located at a paint reservoir and outlet end positioned such that paint flowing through the hollow tube is forced out between the screen and the leading end of the support device.

4. The apparatus in accordance with claim 1 wherein said chuckless advancing means for receiving and rolling the cylindrical object across the surface of the screen comprises a plurality of endless belts positioned essentially parallel to the screen and spaced away from said screen whereby said endless belts contact said cylindrical object and cause said cylindrical object to travel across said screen.

5. The apparatus in accordance with claim 4 wherein said chuckless advancing means for receiving and rolling the cylindrical object further comprises a plurality of backing plates for positively positioning said endless belts with respect to the screen.

6. The apparatus in accordance with claim 5 wherein the distance between the endless belts is adjustable.

7. The apparatus in accordance with claim 6 wherein the speed of the endless belts is adjustable.

8. The apparatus in accordance with claim 7 wherein the distance between the plurality of endless belts and the screen is adjustable.

9. The apparatus in accordance with claim 4 wherein said non-absorbent support device can be adjusted so as to alter the distance between said support device and said plurality of endless belts.

10. The apparatus in accordance with claim 9 wherein the endless belts contact the surface of the cylindrical object only along its endmost portions.

11. The apparatus in accordance with claim 9 further comprising a means for automatically introducing a plurality of the cylindrical objects between the screen and the chuckless advancing means.

12. The apparatus in accordance with claim 11 further comprising a means for aligning the radial orientation of the cylindrical object prior to its introduction between the screen and the chuckless advancing means.

13. The apparatus in accordance with claim 4 wherein the cylindrical object is introduced into the apparatus, advanced through the apparatus, and discharged from the apparatus in a continuous motion.

14. The apparatus in accordance with claim 4 wherein the advancing means is capable of essentially simultaneously advancing a plurality of cylindrical objects across the screen.

15. An apparatus for transferring a pattern to arcuate surface portions of a cylindrical object, the apparatus comprising:

(a) a screen containing the pattern to be transferred to the arcuate surface portions of the cylindrical object;

(b) a non-absorbent, resilient support device having a leading end and a trailing end, said support device positioned adjacent to one side of the screen so as to support said screen;

(c) a means for transporting paint from a reservoir, said means being positioned so as to deliver said paint to the leading end of the non-absorbent, resilient support device at a point between said screen and non-absorbent resiliant support device;

(d) a plurality of endless belts positioned essentially parallel to said screen, opposite of said resiliant support device spaced such that the cylindrical object can pass between said endless belts and said screen;

(e) a means for introducing the cylindrical object to a position between said endless belts and said resiliant support device;

(f) a sensor means located so as to be activated when the cylindrical object is positioned between the endless belts and the resiliant support device; and (g) a pivotal arm positioned so as to force the endless belts downward at a point such that the endless belts contact the cylindrical object, thereby transporting said cylindrical object across the screen, said pivotal arm being engaged when the sensor means is activated.

16. The apparatus in accordance with claim 15 which further comprises a means for raising and lowering said resiliant support device such that the distance between the resiliant support device and the endless belts can be adjusted to accommodate cylindrical objects having various size diameters.

17. The apparatus in accordance with claim 16 which further comprises a means for adjusting the distance between the endless belts to accommodate cylindrical objects having various lengths.

18. The apparatus in accordance with claim 17 wherein said means for transporting paint from a reservoir comprises a hollow tube through which said paint can flow, said hollow tube having an inlet end connected to a paint metering pump located at the reservoir and an outlet end positioned such that paint flowing through the hollow tube is delivered between the screen and the leading end of the non-absorbent, resiliant support device.

19. A process for transferring a pattern from a screen containing the pattern to arcuate surface portions of a cylindrical object, the process comprising:

(a) positioning a non-absorbent support device adjacent one side of the screen;

(b) supplying a layer of paint between the support device and the screen;

(c) maintaining the screen and the support device essentially stationary while advancing the cylindrical object across the opposite side of the screen from the support device; while simultaneously, (d) allowing the cylindrical object to rotate about its axis so that the arcuate surface portions of the cylindrical object are continuously advanced across the pattern of the screen, thereby forcing the paint through the pattern on the screen and onto the arcuate surface portions of the cylindrical object as the cylindrical object is advanced across the screen.

20. The process in accordance with claim 19 wherein the pattern is continuously transferred to a plurality of cylindrical objects.

21. The process in accordance with claim 19 wherein the pattern is simultaneously transferred to a plurality of cylindrical objects.

22. The process in accordance with claim 19 further comprising the step of radially aligning the surface of the cylindrical object prior to advancing the cylindrical object across the screen.

* * * * *